US006481664B1

(12) United States Patent
Bravin

(10) Patent No.: US 6,481,664 B1
(45) Date of Patent: Nov. 19, 2002

(54) AUTOMATIC TAPE CROSSOVER

(75) Inventor: Ben Bravin, Los Angeles, CA (US)

(73) Assignee: Dynamex Corporation, Carson, CA (US)

( * ) Notice: Subject to any disclaimer, the term of this patent is extended or adjusted under 35 U.S.C. 154(b) by 48 days.

(21) Appl. No.: 09/678,057

(22) Filed: Oct. 2, 2000

(51) Int. Cl.[7] ..... B65H 19/14; B65H 19/18; B65H 19/20

(52) U.S. Cl. ..... 242/552; 242/555.1; 156/504

(58) Field of Search ..... 242/552, 554.2, 242/555.1; 156/502, 504

(56) References Cited

U.S. PATENT DOCUMENTS 3,024,157 A * 3/1962 Beerli ..... 156/504
4,077,580 A * 3/1978 Lang ..... 242/554.2
4,089,482 A * 5/1978 Mooney ..... 242/554
4,113,197 A * 9/1978 Harrington ..... 242/554.4
4,157,934 A * 6/1979 Ryan ..... 156/504
4,219,378 A * 8/1980 Marschke ..... 156/502
4,264,401 A * 4/1981 Ganz ..... 156/504
4,848,691 A * 6/1989 Muto ..... 242/553
5,045,134 A * 9/1991 Schenker ..... 156/64
5,388,387 A * 2/1995 McElvy ..... 53/451
5,411,223 A * 5/1995 Gatteschi ..... 242/551
6,247,515 B1 * 6/2001 Spatafora ..... 156/504
6,328,088 B1 * 12/2001 Draghetti ..... 156/504

OTHER PUBLICATIONS

Bravin, Ben, *Taping System Offers Fully Automatic Crossover*, Wine Journal International, Aug. 2000 at 150.

* cited by examiner

*Primary Examiner*—John M. Jillions
(74) *Attorney, Agent, or Firm*—Blakely Sokoloff Taylor & Zafman LLP

(57) ABSTRACT

An automatic tape crossover machine having two feeding mechanisms to supply running and new tapes, respectively. A powered cutter is provided through which the running tape is to pass and be cut in response to a cut signal, where the cutter is positioned downstream of the first tape feeding mechanism. The machine also includes a joining mechanism at which a portion of a new tape is to be joined to the running tape in response to a join signal. Control circuitry automatically determines whether a tape exhaustion condition has been reached and asserts the join and cut signals to join the running and new tapes and to cut the running tape, before the tape feeding mechanism is emptied of the running tape. The machine thus allows the automatic transition from the running tape to the new tape, i.e. without requiring the presence or manual assistance of a human operator when joining the two tapes. In addition, the process line speed need not be altered for the crossover, thereby reducing the probability of inconsistencies in product quality.

28 Claims, 6 Drawing Sheets

AUTOMATIC TAPE CROSSOVER

BACKGROUND

This invention is generally related to equipment used for paying off tape into a process. More particularly, the invention is related to automatically performing a "crossover", i.e. transitioning from a running tape to a new tape.

The process of manufacturing of electrical and optical cable (having one or more filaments or conductors) often requires that tape be continuously pulled in and folded or wrapped around a cable component. For instance, in the manufacture of electrical shielded cable, the tape material is a pliable metallic foil that is pulled in by the core of the cable and is wrapped around the core in a helical manner as the continuously manufactured part is rotating. Other tape materials include paper, plastic, and metallized plastic. In other instances, such as an extrusion for cable jacketing, the tape does not rotate but rather forms a "cigarette wrap" around the manufactured part. The tape itself may be supplied as a flat roll whose width is the same as the tape width, sometimes called a pancake pad. Another tape packaging configuration is a wide roll where the tape is traversed, or oscillated, back and forth while being wound onto a center tube. Both types of rolls have a center tube which is typically of cardboard or plastic and enables mounting the roll onto tape payoff equipment.

In the tape payoff equipment, the roll is mounted on a shaft which is attached to a brake or a motor to apply positive or negative torque on the roll as the tape is being pulled out by the manufacturing process. When the roll is about to be emptied, a crossover to a new roll must be performed, preferably without slowing or stopping the process.

One technique for achieving crossover without stopping the process uses the following mechanism. Two tape positions are provided, one of which is running and the other is available for the crossover. The running tape has an in-line accumulator, generally in the form of a narrow box where the tape is folded back and forth in a serpentine form. The accumulation is maintained by supplying a length of tape continuously, equal to the length of tape being pulled out of the box. When the time for a changeover arrives, a clamp is applied to the upstream portion of the accumulation. Thus, the tape being fed into the process is now being sourced by the accumulation which is gradually being depleted due to the clamp being applied to its upstream portion. A human operator is given a limited amount of time to perform a manual joining of the clamped end of the running tape to the leading edge of tape from a new roll. This joining must be performed before the accumulation has been completely depleted, otherwise there will be an interruption in the feeding of tape to the process (and the tape will brake). The amount of time available for this manual joining depends on the amount of accumulation and on the line speed of the tape, i.e. the speed at which the tape is being pulled in by the manufacturing process. For certain high speed processes, the line speed must be lowered temporarily to allow this crossover. In addition to the presence of the operator being required at the right moment, the operator must also have a certain degree of agility and skill to perform the manual joining in the limited period of time.

Other tape payoff operations do not have the accumulation as described above, so as to reduce the cost of the operation. In such operations, the line speed is lowered, sometimes by a factor of ten, so that the operator can manually attach the new tape to the running tape, by means of an adhesive tape. The running tape is then manually cut after joining with the new tape, before the line speed is raised back to its normal level. However, in addition to the problems described above including the presence of an operator at the right moment and the high degree of skill and dexterity required of the operator, changing the speed of the manufacturing process may adversely affect product quality.

SUMMARY

An embodiment of the invention is directed to an automatic tape crossover machine having two feeding mechanisms to supply running and new tapes, respectively. A powered cutter is provided through which the running tape is to pass and be cut in response to a cut signal, where the cutter is positioned downstream of the first tape feeding mechanism. The machine also includes a joining mechanism at which a portion of a new tape is to be joined to the running tape in response to a join signal. Control circuitry automatically determines that a tape exhaustion condition has been reached and asserts the join and cut signals to join the running and new tapes and to cut the running tape, before the tape feeding mechanism is emptied of the running tape. The machine thus allows the automatic transition from the running tape to the new tape, i.e. without requiring the presence or manual assistance of a human operator when joining the two tapes. In addition, the process line speed need not be altered for the crossover, thereby reducing the probability of inconsistencies in product quality.

BRIEF DESCRIPTION OF THE DRAWINGS

The invention is illustrated by way of example and not by way of limitation in the figures of the accompanying drawings in which like references indicate similar elements. It should be noted that references to "an" embodiment in this disclosure are not necessarily to the same embodiment, and they mean at least one.

DETAILED DESCRIPTION

Figure 1:
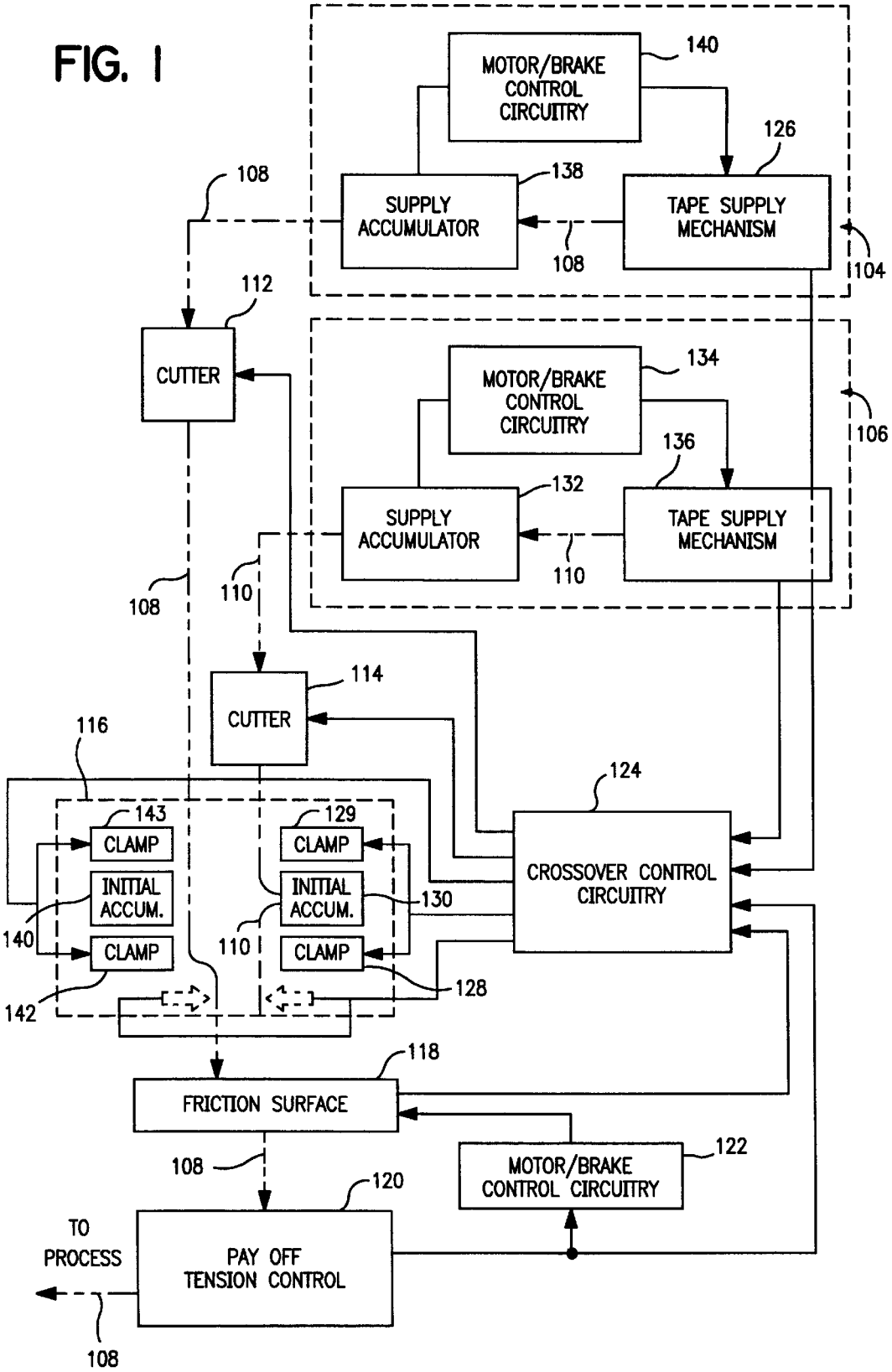
FIG. 1 depicts a block diagram of a tape crossover machine according to an embodiment of the invention.

FIG. 1 shows a block diagram of an embodiment of the automatic tape crossover machine. First and second tape feeding mechanisms 104, 106 are provided to supply a running tape 108 and a new tape 110, respectively. These tapes may be suitable for making electrical and optical cable by a cable manufacturing process (not shown). Each tape feeding mechanism 104/106 includes a motorized tape supply mechanism 126/136 which feeds tape to a supply accumulation section 138/132. This section provides accumulation between the feeding mechanism and a joining mechanism 116 downstream. Motor and/or brake control circuitry 140/134 receives feedback from the supply accumulation section, based upon, for instance, an indication of the amount of accumulation remaining, as well as perhaps a change in the tape payoff speed, to increase or decrease the rate at which tape is being supplied by the tape supply mechanism 126/136 so as to ultimately match the process line speed.

The running tape 108 and the new tape 110 are routed through respective powered cutters 112 and 114 where the tape may be cut in response to a cut signal. Note that the cutters are positioned downstream of the tape feeding mechanisms 104, 106 as shown. Each cutter may feature an electrically actuated blade which moves to cut the tape in response to an electrical signal. In a particular embodiment, each cutter 112, 114 further includes a cutter-clamp, to prevent the upstream end of the tape from falling into any moving paths of the machine after the tape has been cut. The first cutter 112 may be instructed to clamp and then cut the running tape 108 at the moment of joining the new tape to the running tape, or with a small delay or advance. The excess loose portion of the running tape 108 beyond the new joint may be minimized by, for instance, moving the first cutter 112 downstream, closer to the position at which the joint is formed.

A joining mechanism 116, positioned downstream of the cutters 112, 114 in this embodiment, joins the running tape 108 to the new tape 110 in response to a join signal. The running tape then continues to an optional rotatable friction surface 118 by which it may be pulled. The running tape then continues through an optional payoff tension control section 120 which may provide some accumulation as well as control the tension on the tape that is being paid off to the cable manufacturing process. The friction surface 118 allows some tension decoupling between the joining mechanism 116 that is upstream and the tension provided to the process which is downstream. The friction surface may be part of, for instance, a capstan which is rotatably coupled to a drive or braking means such as a four quadrant electric motor. Motor and/or brake control circuitry 122 may be provided to increase or decrease the rotation speed of the capstan as needed to maintain a certain amount of accumulation and tension downstream for the process, while matching the process speed.

The machine also includes programmable crossover control circuitry 124 which automatically determines whether a tape exhaustion condition has been reached. This condition may be, for instance, a predetermined period of time (as programmed by an operator) that tape from a given roll should run before performing a crossover. Alternatively the tape exhaustion condition may be a predetermined length of running tape remaining in a roll. For instance, based upon a speed of the running tape, such as the line speed as measured by the payoff tension control section 120, and a preset tape length value, the control circuitry 124 asserts the join and cut signals to the joining mechanism 116 and the cutter 112, when the length of tape remaining in the first tape supply mechanism 126 equals the preset value.

The crossover control circuitry 124 generates its join, clamp release, and cut signals in response to determining, for instance, that a tape supply mechanism 126/136 is about to run out of tape. When a computed remaining tape length value equals the preset remaining tape length value, it may be time to join the tapes. The remaining tape length may be computed based upon a signal that represents a diameter of a roll of tape in the tape supply mechanism 126/136, a thickness of the tape which may have been previously programmed into the circuitry 124 by the operator, and the current process line speed as measured for instance by the payoff accumulator and tension control section 120. The diameter of the roll of tape may be obtained by optically or mechanically sensing the roll in the tape supply mechanism 126, or by computing the diameter from a ratio of the roll rotation speed to the rotation speed of the capstans friction surface 118. The circuitry may feature a digital controller that is programmed to operate a closed loop control system based upon digitized versions of the process parameters mentioned above, including line speed and tape roll diameter and thickness.

In a particular embodiment, the joining mechanism 116 includes a first clamp mechanism having a first clamp element 128 to (1) hold an end portion of the new tape 110 in position for joining to the running tape 108, and (2) release the new tape 110 in response to a clamp release signal asserted by the control circuitry 124. In a further embodiment, a second clamp element 129 holds an upstream portion of the new tape, so that the tape does not move back towards the supply section 132. The essentially inertia-free or mass-free initial accumulation 130 of the new tape 110, such as a loose loop or several loose folds, may be provided between these two held portions. When the new tape 110 is pulled along with the running tape 108 joined to it, the joint is initially subjected to essentially no tension as the new tape 110 is drawn out of the initial accumulation 130, thereby allowing the joint to strengthen if needed to resist a specified tension. The clamp mechanism may be electrically actuated in response to an electrical signal that is provided by the crossover control circuitry 124.

Once the initial accumulation 130 has been exhausted, the new tape 110 (which is now "running") will start using the accumulation provided by the second supply accumulator section 132. This additional accumulation helps further minimize any inertia loads that may otherwise subject the new joint to unacceptably high tensions. The second tape feeding mechanism 106 will sense the depletion of its accumulated new tape in section 132 and, in response, using motor-brake control circuitry 134, signals a roll drive in the tape supply mechanism 136 to increase the rate at which the new tape 110 is being fed, towards ultimately matching a line speed of the manufacturing process.

The embodiment of the invention in FIG. 1 shows the joining mechanism 116 as having an initial accumulation 130 for the new tape 110 and a first clamp element 128 to hold the new tape 110 in position for joining with the running tape 108. This permits a running tape that is passing through the left side of the mechanism 116 to be joined to a new tape at the right side. In a further embodiment of the invention, the mechanism 116 is equipped with an additional area of second initial accumulation 140 and a second clamp mechanism having clamp elements 142 and 143, such that a running tape on the right side may be joined with a new tape held at the left side. The crossover control circuitry 124 is also modified in such an embodiment to recognize that automatic crossovers may be performed in both positions, namely that the new tape may be at either the left or right side of the mechanism 116. This allows successive crossovers to be performed in which the new tape alternates from one side to another. Operation in such an embodiment would proceed as follows. First, tape from a first roll is routed through the first cutter 112 and then through the joining mechanism 116 and then to the cable manufacturing process. Tape from a second roll is routed through the second cutter 114. An end portion of the second tape is positioned next to the first tape in the joining mechanism, using the first clamp element 128. After running the cable manufacturing process and paying off tape from the first roll, an automatic tape crossover may be performed when the first roll is close to being depleted, as determined by the crossover control circuitry 124.

After the first tape, which has been routed through the left side of the mechanism 116, has been cut following the joint, and the first clamp element 128 has been signaled to release the second tape, a new roll of tape is provided to the first tape supply mechanism 126. This tape thus becomes the "new tape" for the next crossover. This new tape is now routed through the first cutter 112 and into the left side of the mechanism 116 where it is held in position by the clamp element 142. The crossover control circuitry 124 recognizes that the running tape for the process is now being supplied by the second tape supply mechanism 136 and accordingly monitors the second tape supply. The joining mechanism 116 is signaled to form the joint between the new tape and the running tape before the second supply runs out. The procedure may repeat by replacing the current roll in the second tape supply mechanism with yet another new roll of tape.

Figure 2:
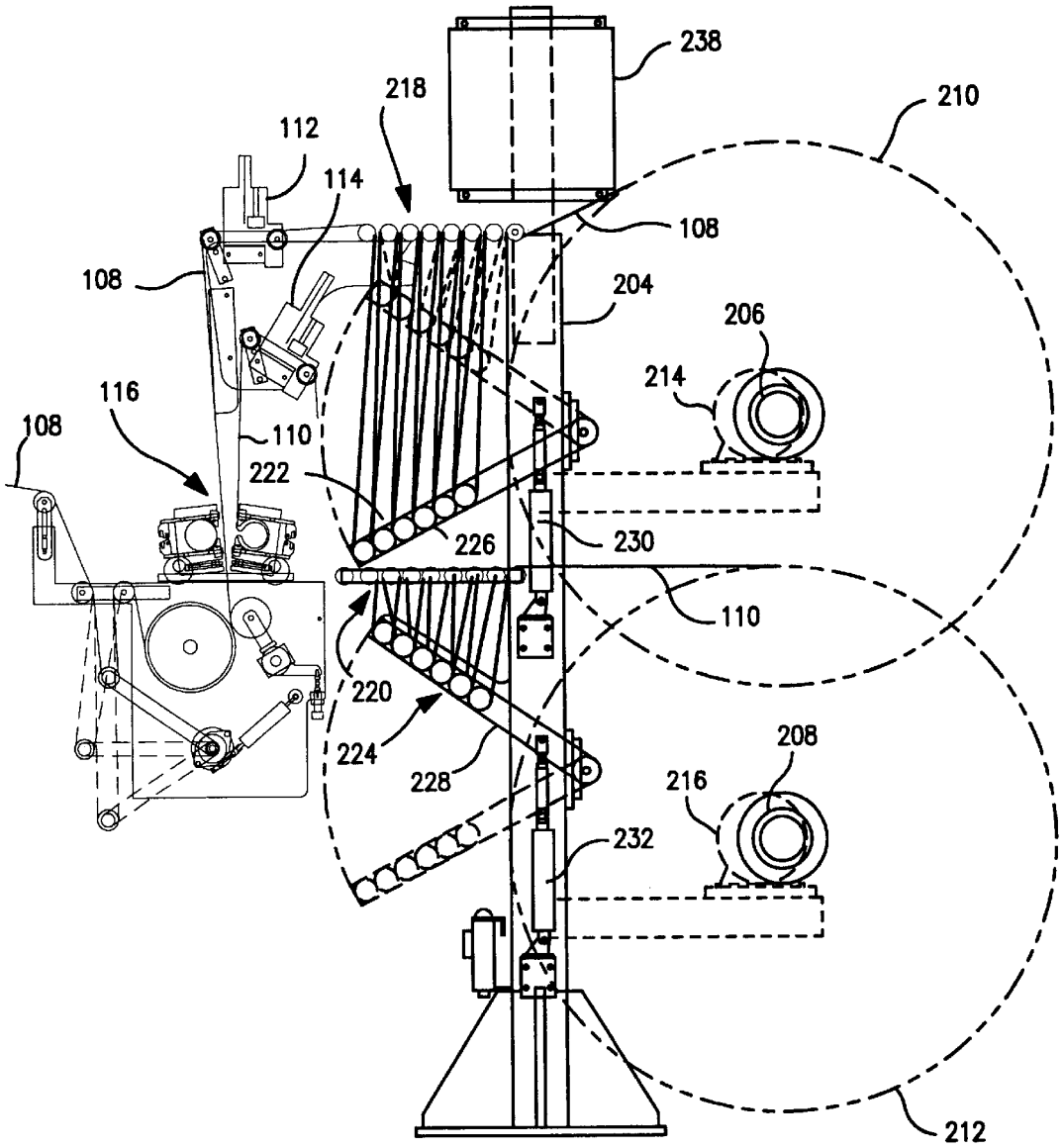
FIGS. 2 and 3 illustrate a schematic of another embodiment of the automatic tape crossover machine.
Figure 3:
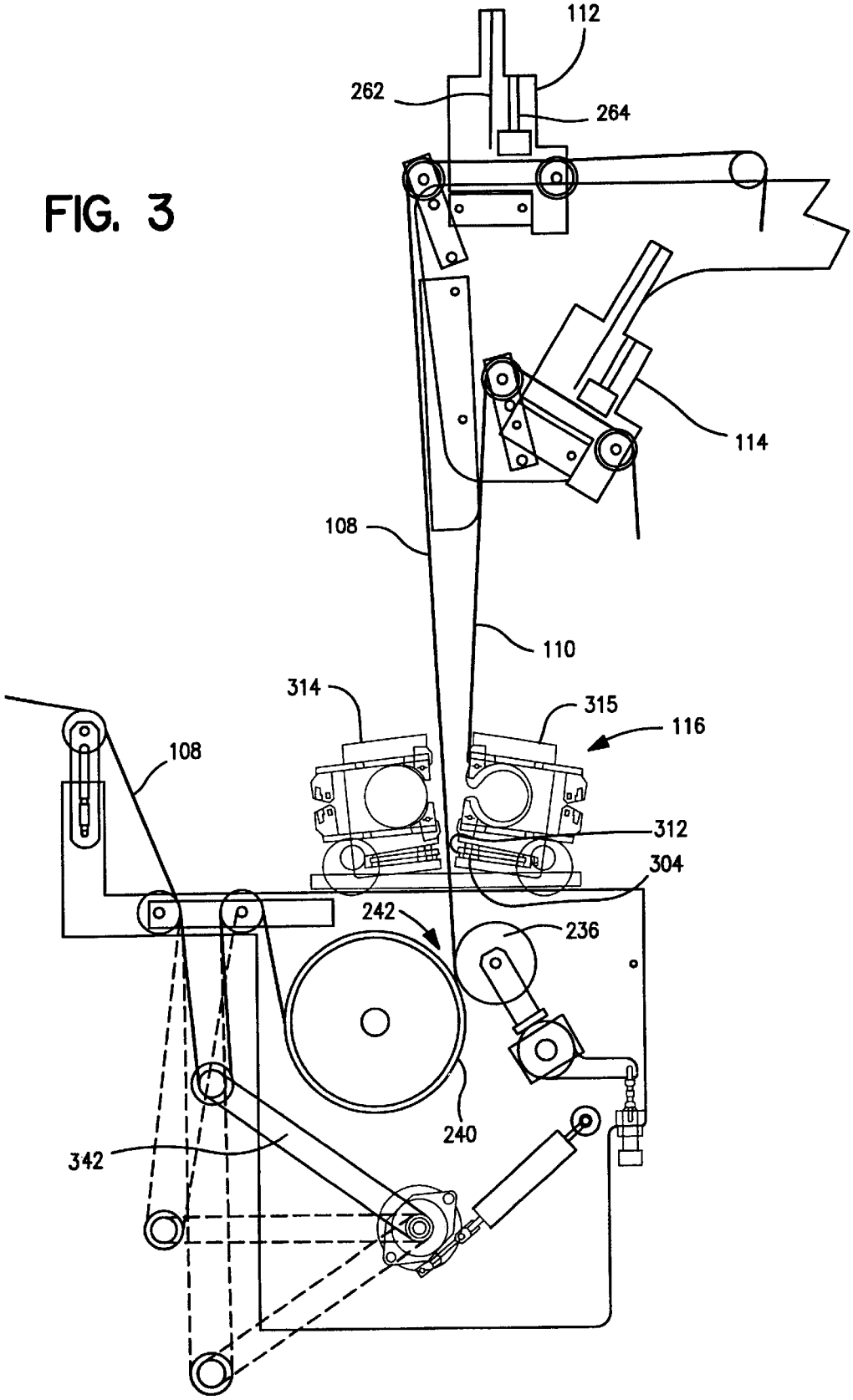

FIGS. 2 and 3 show a detailed schematic of a tape crossover machine according to an embodiment of the invention, with FIG. 3 being a slightly expanded version of FIG. 2. The machine has a frame 204 with two independent shafts 206, 208, where each shaft is adapted to removably receive and lock with a roll of tape 210, 212. Each shaft is driveably coupled to a tape roll driving and braking means such as a four quadrant electric motor 214, 216. Two accumulators each including a set of fixed rollers 218, 220 and a set of moveable rollers 222, 224 are provided. The distance between the fixed and moving rollers is changed by a pivoting motion of the moveable rollers. The assembly containing the moveable rollers is called a dancer 226, 228, and is mechanically loaded by a device capable of exerting an adjustable force, such as an air cylinder 230, 232, to affect tension on the tape 108, 110. The tape has been threaded in a serpentine form, alternating between the fixed rollers and the moveable rollers as shown. An alternative to the pivoting movement of the dancer 226, 228 is one that exhibits linear movement.

The dancer 226, 228 is attached to a device such as a potentiometer (not shown) which senses the position and velocity of the dancer, to provide a feedback signal to control the driving and braking of the shafts 206, 208. This closed-loop control may be achieved using control circuitry 238 that may include a programmable logic controller (PLC) to analyze the dancer data and in response control the operation of the air cylinders 230, 232 and the motors 214, 216 to achieve a desired amount of accumulation and tension in the steady state.

Referring now to FIG. 3, each powered cutter 112, 114 has an actuateable blade 262 and an actuateable cutter-clamp 264 positioned upstream of the blade 262. The blade and the cutter-clamp may be electrically actuated, as signaled by the crossover control circuitry 124 (see FIG. 1) at the time of crossover to clamp and then cut the running tape 108.

The joining mechanism 116 may include, in a particular embodiment, a pusher mechanism that has one or more pushers 304. The portions of the new tape 110 and running tape 108 are to be sandwiched preferably between a pusher and another surface (such as another pusher) in response to the join signal. The surface of the new tape which faces a joining surface of the running tape may be provided with an adhesive material, such as double sided adhesive tape 312, to secure the joint. Means other than double sided adhesive tape for joining the portion of the new tape to the running tape may be used. In addition, means other than a pusher (which makes physical contact with the tape) such as a vacuum-assisted or blowing mechanism that brings the two tapes into contact or forms a joint between them, may alternatively be used.

In a particular embodiment, a pinch roller 236 is force-loaded (e.g. spring-loaded) to the friction surface of a capstan 240, to provide a pinch point 242 to press against and pull the running tape 108. The pinch point 242 is positioned downstream of the joining mechanism 116. In this embodiment, the initial accumulation provided in the joining mechanism 116 (see FIG. 1) may be at least as long as a tape path between the pinch point 242 and the point at which the new tape and the running tape are to be sandwiched so that the new joint is not subjected to any significant tension until after the joint has entered the pinch point 242. This also serves to strengthen the adhesion of the new tape to the running tape while driving both tapes at the line speed.

In a particular embodiment, immediately following the capstan 240 is a mechanically loaded second dancer 342 which helps control the tension on the running tape being fed to the process. Once again, velocity and position sensing means such as a potentiometer (not shown) are provided to give dancer position and velocity feedback to motor and/or brake control circuitry 122 (see FIG. 1) which uses the information to control the capstan rotation speed, the amount of accumulation provided by the dancer 342, and the tension on the tape being fed to the process.

Referring back to FIG. 1, at the moment a crossover is to occur, the new tape 110 may be attached instantly to the running tape 108 which is moving at a relatively high speed. In the absence of the initial accumulation 130 and the accumulation in section 132, the new tape roll in the second tape supply mechanism 136 would need to be accelerated instantly, from a standstill to full line speed, on its outside circumference. Even with the use of an accumulator in section 132 in the path of the new tape 110, this accumulator may still need to be instantly accelerated from a standstill. This instant acceleration of the accumulator mass generates an inertia force impact which may not be overcome by the initial attachment of the new tape to the running tape thereby potentially causing the initial attachment to fail. According to an embodiment of the invention, this difficulty is overcome by adding a mass-free initial accumulation 130 of the new tape 110. In this way, the acceleration of the new tape from standstill does not require overcoming any significant inertia force because the tape drawn comes from this mass-free accumulation and does not involve accelerating any external mass.

The length of this initial accumulation 130, in a preferred embodiment as shown in FIG. 3, exceeds the distance from the pusher 304 to the subsequent pinch point 242. After the impact creating the initial attachment of the new tape to the running tape, the running tape 108 carries the new tape 110 through the pinch-point 242 which helps to reinforce the attachment.

By the time the accumulated new tape 110 in the section 132 (see FIG. 1) must start moving, with a resulting inertia force being applied on the tape, the attachment has passed through the pinch point 242 and is on its way to the process, and hence is not subject to such forces, because the new tape 110 is now being pulled at a position upstream of the attachment by the friction of the pinch point 242. It should be noted that the inertia force required to accelerate the accumulator in the section 132 (see FIG. 1) should not exceed the permissible tension of the new tape 110. The accumulator in the section 132 proceeds to supply its accumulation to the process, while signaling to the roll drive to accelerate up to line speed.

Figure 4:
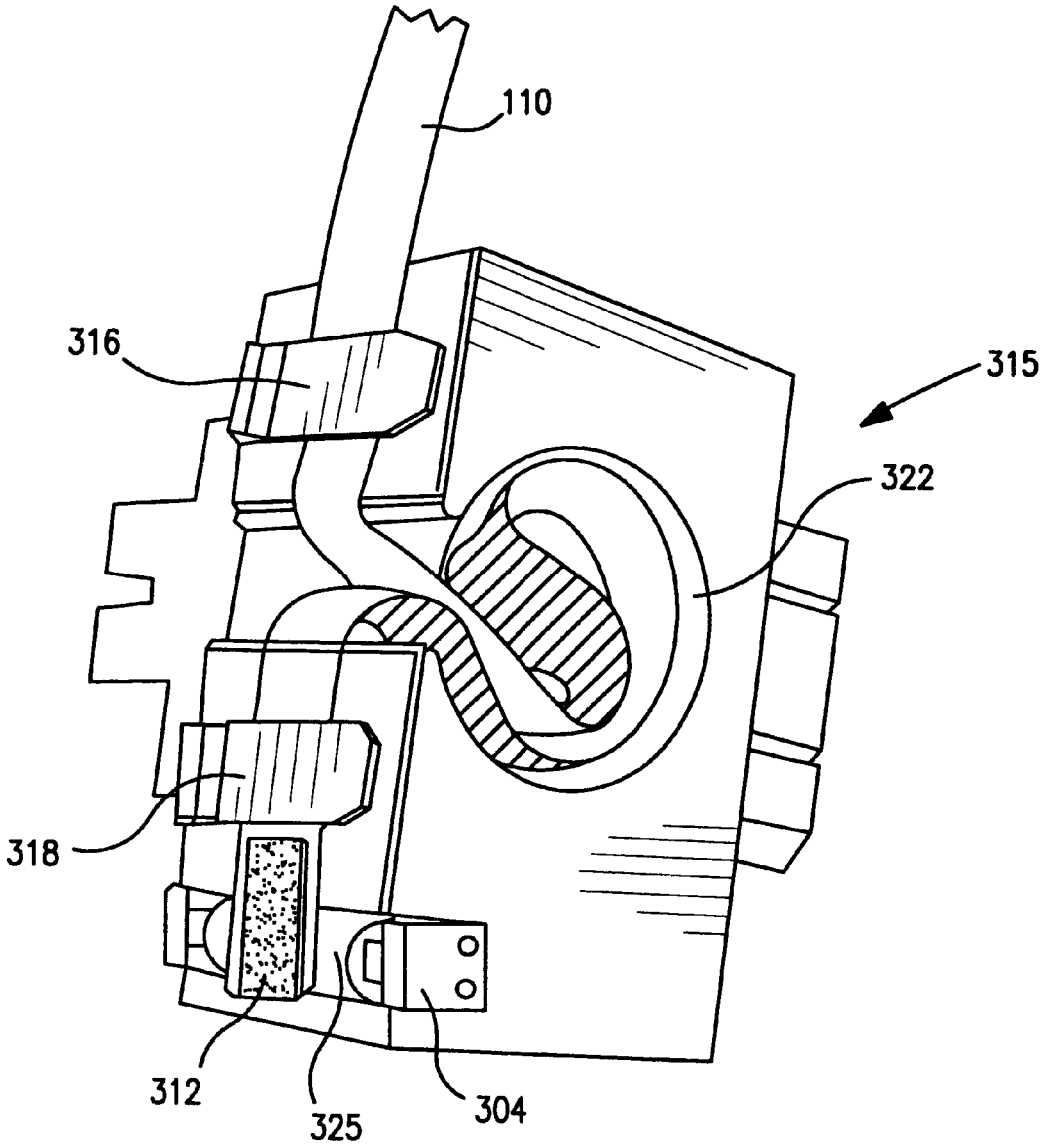
FIG. 4 illustrates a schematic of the detail for an embodiment of the joining mechanism.

In a particular embodiment of the invention, the joining mechanism 116 includes two essentially symmetrical blocks 314, 315 as shown in FIG. 3. A detail view of the block 315 is shown in FIG. 4. Each block has a powered pusher 304 with a roller 325 on the outside. At least one of the blocks is movable between an operating position and a preparation position. FIG. 3 illustrates the blocks 314, 315 in their operating position.

Figure 5:
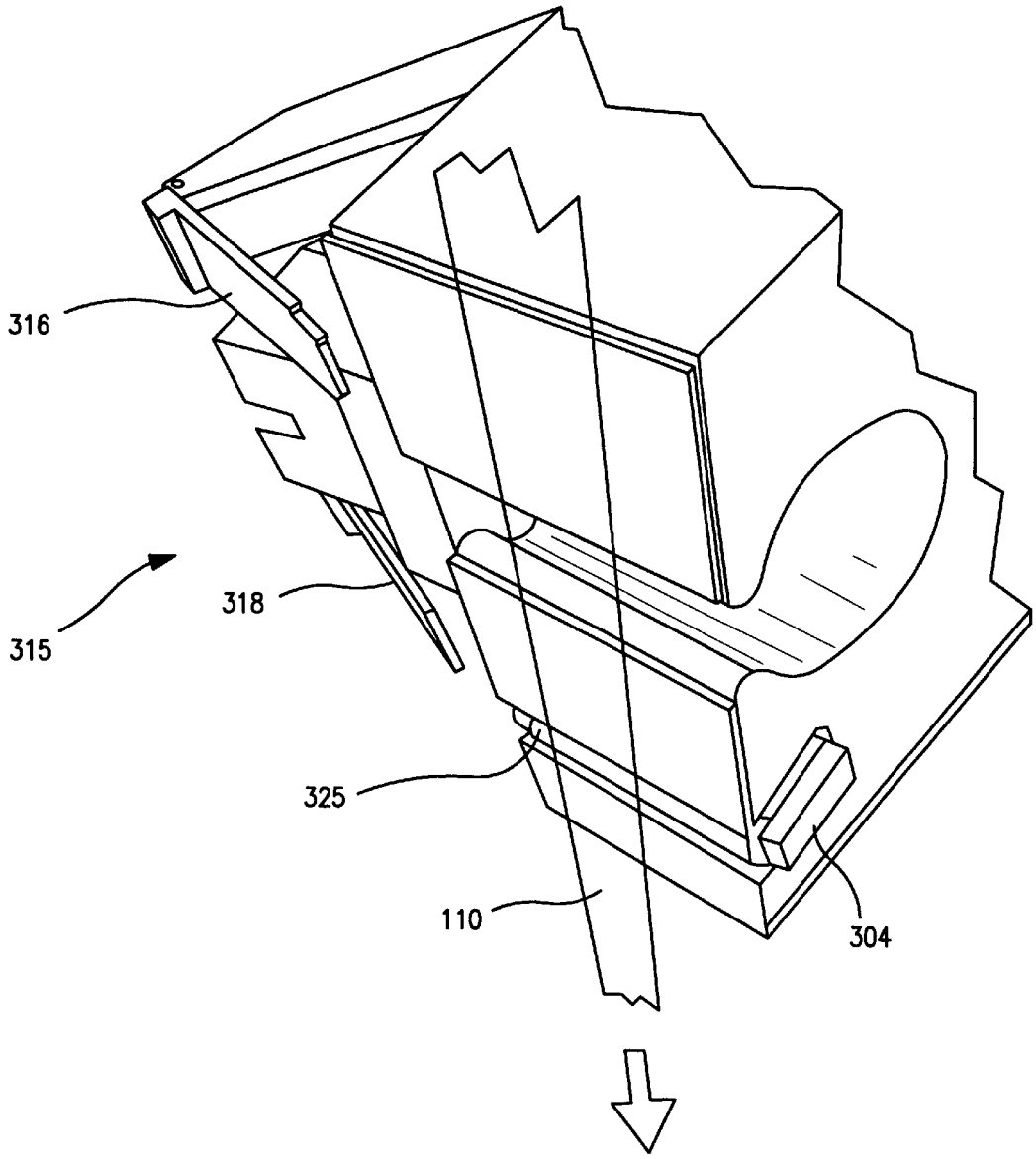
FIG. 5 shows an embodiment of the joining mechanism in which the clamps are in their released position.

When the blocks are in the preparation position, a human operator can position an end portion of the new tape 110 for example, across the pusher 304, to be held by the clamps. In FIG. 4, the new tape 110 is shown as having an end portion positioned across the roller 325. This end portion has a double-sided adhesive tape 312 to make a joint with the running tape (not shown). The clamp mechanism in this embodiment includes two fingers 316 and 318, where 318 holds the downstream portion and 316 holds the upstream portion of the new tape 110. In a particular embodiment, each finger is magnetically attracted to the face of the block, to hold the tape in position. Referring now to FIG. 5, when a clamp release signal (which may be the same as the join signal) is received, the fingers 316 and 318 are pivoted backwards so as to lift off the surface of the block (after overcoming the magnetic force). This allows the new tape 110 which has been joined to the running tape to move freely across the block. An alternative to the magnetically attracted fingers 316, 318 may be to provide vacuum regions, such as holes, in the surface of the block at which the new tape 110 is to be held. A vacuum may then be applied in response to a clamp signal being asserted to suck and thereby clamp the new tape 110 against the face of the block. Such vacuum clamping may be used for very sensitive tape materials, such as tissue.

Referring still to FIG. 4, each block may further feature a cavity 322 in which the initial accumulation of the tape is kept as a loose loop or several loose folds as shown in the figure. Other means for preventing the loose loop or folds from falling into moving paths of the machine may alternatively be used.

Figure 6:
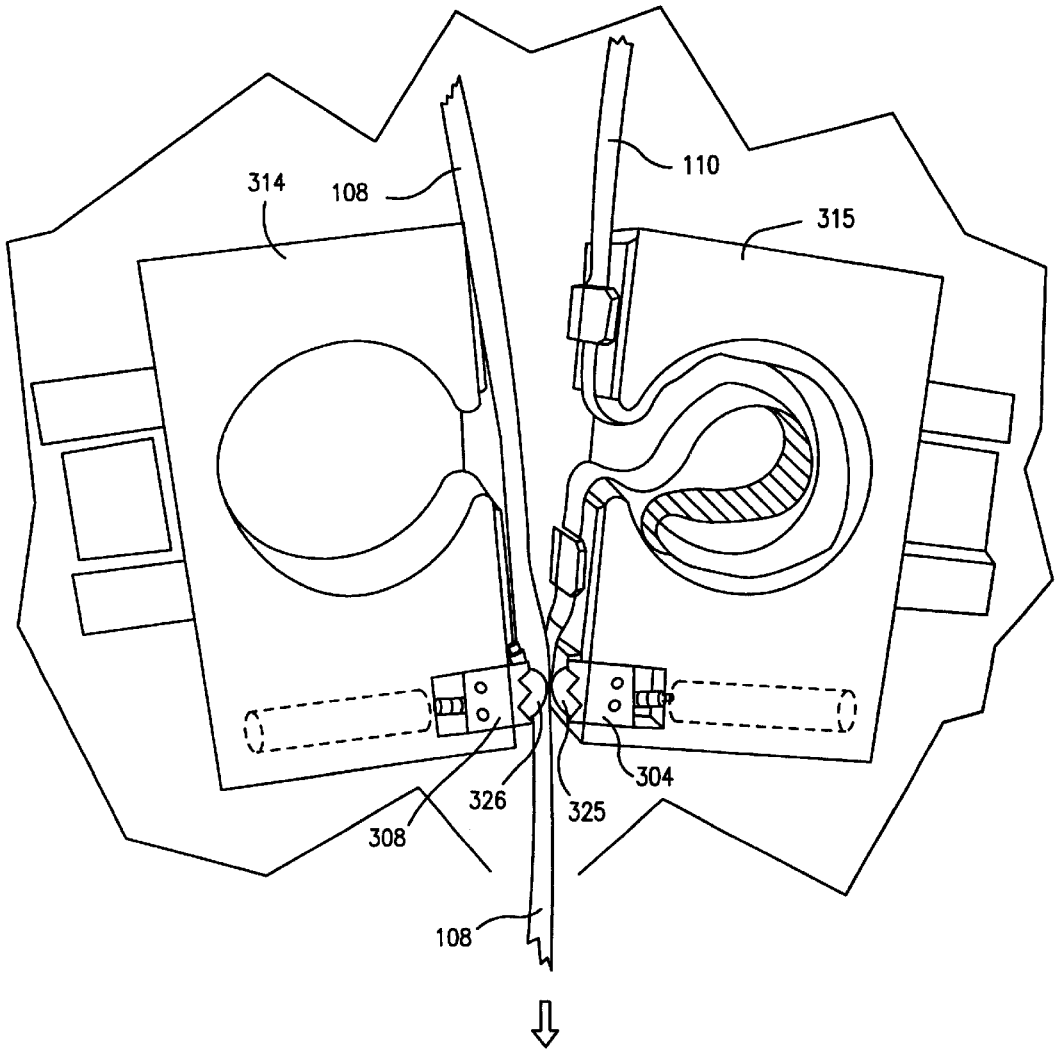
FIG. 6 depicts a schematic of the blocks in the joining mechanism in their operating position, and where the pushers have both extended outwards and are sandwiching the running and new tapes.

FIG. 6 illustrates the operating position of the blocks in the joining mechanism 116, and in addition shows two pushers 304 and 308 in their extended positions at which two rollers 325, 326 sandwich the running tape 108 and the adhesive-covered new tape 110. The pushers 304, 308 may be force-loaded (e.g. spring loaded) by a preset force that is applied to press each tape against the other when the pushers are extended outwards towards each other. In this manner, the two tapes are joined according to the preset force as they move against the rollers, which turn in opposite directions while the running tape 108 is being pulled. The pushers then retract, as commanded by the control circuitry 124 (see FIG. 1), preferably as soon as the entire length of the adhesive material has passed by the contact point of the rollers 325, 326. After the joint has been created in this manner, or with a small delay or advance, the running tape 108 is clamped and cut.

In the foregoing specification, the invention has been described with reference to specific exemplary embodiments thereof. It will, however, be evident that various modifications and changes may be made thereto without departing from the broader spirit and scope of the invention as set forth in the appended claims. For instance, although the tape crossover mechanism has been described in the context of transitioning to a new tape when a roll of running tape is about to finish, the crossover could occur for reasons other than the roll of the running tape being close to empty. The machine may have a manual override in which the operator actuates the joining and cutting at an arbitrary point in time. In addition, the new tape and the running tape need not be identical types, and may be of different types so long as one can be joined to the other. The specification and drawings are, accordingly, to be regarded in an illustrative rather than a restrictive sense.

What is claimed is:

1. An automatic tape crossover machine comprising:

first and second tape feeding mechanisms to supply running and new tapes, respectively;

a first powered cutter through which the running tape is to pass and be cut in response to a cut signal, the first cutter being positioned downstream of the first tape feeding mechanism along the first tape;

a powered joining mechanism in which an end portion of the new tape is to be joined, at a position downstream, of the first cutter, to the running tape in response to a join signal wherein the joining mechanism further provides an essentially inertia-free accumulation of the new tape and further includes a pusher mechanism downstream of the accumulation and having at least one pusher and another surface between which the portion of the new tape and the running tape are to be sandwiched and passed in response to the join signal;

a friction surface to which a pinch roller is coupled, to provide a pinch point on the running tape, the pinch point being positioned downstream of the pusher mechanism, and wherein the essentially inertia-free accumulation is at least as long as a tape path between the pinch point and the point at which the new tape and the running tape are to be sandwiched; and control circuitry to automatically determine whether a tape exhaustion condition has been reached and assert the join and cut signals to (1) join the running and new tapes and (2) cut the running tape, before the first tape feeding mechanism is emptied of the running tape.

2. The machine of claim 1 wherein the joining mechanism includes a first clamp to (1) hold the end portion of the new tape in position for joining to the running tape, and (2) release the new tape in response to a clamp release signal asserted by the control circuitry.

3. The machine of claim 2 wherein the clamp is to hold an upstream portion and a downstream portion of the new tape so that the essentially inertia-free accumulation of the new tape is provided between these two held portions.

4. The machine of claim 2 further comprising:

a second powered cutter through which the new tape is to pass and be cut in response to a cut signal, the second cutter being positioned downstream of the second tape feeding mechanism along the new tape.

5. The machine of claim 4 wherein the joining mechanism further includes a second clamp to (1) hold a portion of a third tape in position for joining to the new tape when the new tape is running, and (2) release the third tape in response to a clamp release signal asserted by the control circuitry.

6. The machine of claim 5 wherein the second clamp is to hold an upstream portion and a downstream portion of the third tape so that an essentially inertia-free accumulation of the third tape is provided between these held portions.

7. The machine of claim 1 wherein the control circuitry is to determine the tape exhaustion condition by determining a length of the running tape remaining in the first tape feeding mechanism.

8. A longitudinal tape payoff machine to be positioned upstream of and to feed tape to a cable manufacturing process comprising:

a pair of motor-driven shafts, each to receive a roll of running tape and a roll of new tape, respectively, that are suitable for making at least one of electrical and optical cable;

a pair of accumulator sections positioned downstream of the shafts in the paths of the running and new tapes, to provide accumulation for the running and new tapes, respectively, and to provide feedback to control the driving of the shafts;

first and second powered cutter-clamps and cutting blades positioned downstream of the accumulator to clamp and cut the running tape and the new tape, respectively;

first and second blocks positioned downstream of the clamps and cutting blades, each block having a powered pusher, at least one of the blocks being movable between a preparation position and an operating position, the preparation position allows a human operator to position an end portion of the new tape across one of the pushers, the operating position brings the pushers near each other and allows the new tape and the running tape to be joined by moving at least one of the pushers;

a rotatable friction surface to which a pinch roller is coupled to provide a pinch point at a location downstream of the blocks on the running tape, an essentially inertia-free accumulation of the new tape to be provided by one of the first and second blocks and that is at least as long as a tape path between the pinch point and the point at which the running and new tapes are to be joined when the block is in the operating position; and a controller to automatically determine whether a tape exhaustion condition has been reached and signal the actuation of (1) at least one of the pushers to join the end portion of the new tape to the running tape, and (2) the first powered cutter clamp and cutting blades to clamp and cut the running tape.

9. The machine of claim 8 wherein each block further includes a powered clamp to (1) hold a portion of the new tape in position for joining to the running tape, and (2) release the new tape in response to a signal from the controller.

10. The machine of claim 9 wherein the clamp is to hold an upstream portion and a downstream portion of the new tape so that said essentially inertia-free accumulation of the new tape is provided between these two held portions, and wherein the pushers are downstream of the accumulation.

11. The machine of claim 10 wherein each block further includes a cavity in which the essentially inertia-free accumulation of tape is kept.

12. The machine of claim 8 wherein each pusher has a roller at its outside surface to contact a surface of the new running tapes, respectively.

13. The machine of claim 8 wherein the controller is to determine the tape exhaustion condition by determining when a predetermined period of time as programmed by an operator has elapsed.

14. A method for paying off tape, comprising:

routing tape continuously from a first roll through a first cutter and through a joining mechanism and by a pinch roller and to a manufacturing process;

routing tape continuously from a second roll through a second cutter and then positioning an end portion of the second tape next to the first tape in the joining mechanism with an essentially inertia-free accumulation of the second tape being at least as long as a tape path from a pinch point of the pinch roller to a point at which the first and second tapes are joined by the joining mechanism;

running the manufacturing process to pull tape continuously from the first roll;

before the first roll is depleted and without stopping the running of the cable manufacturing process (1) automatically joining the end portion of the second tape with the first tape and (2) automatically cutting the first tape at a position on the first tape that is upstream of a joint between the first and second tapes; and then replacing the first roll with a third roll; and then routing tape continuously from the third roll through the first cutter and then positioning an end portion of the third tape next to the second tape in the joining mechanism.

15. The method of claim 14 further comprising:

before the second roll is depleted and without stopping the running of the cable manufacturing process, automatically (1) joining the end portion of the third tape with the second tape, and (2) cutting the second tape at a position on the second tape that is upstream of a joint between the second and third tapes.

16. The method of claim 15 wherein the manufacturing process is a cable manufacturing process.

17. The method of claim 14 wherein the joining and cutting are performed without slowing down the manufacturing process.

18. An apparatus comprising:

means for making a joint between a running first tape and an end portion of a stationary second tape;

means for cutting the first tape upstream of the joint;

means for strengthening the joint;

means for providing an inertia-free accumulation of the second tape that is at least as long as a distance between the joint making and strengthening locations; and means for automatically controlling the cutting and joining means in response to detecting that the running first tape is near depletion.

19. The apparatus of claim 18 further comprising:

means for controlling a tension in the running first tape downstream of the strengthening means.

20. The apparatus of claim 19 further comprising:

means for providing the first tape;

means for accumulating the first tape downstream of the first tape providing means and upstream of the cutting and joint making means; and means for controlling the first tape providing means in response to detecting an amount of accumulation remaining in the accumulation means.

21. The apparatus of claim 20 further comprising:

means for tension decoupling in the running first tape between a tension at the joint making means and a tension at the tension controlling means.

22. The apparatus of claim 21 further comprising:

means for controlling the tension decoupling means to maintain a predetermined amount of accumulation and tension downstream in the tension control means.

23. An apparatus comprising:

first and second tape feeding mechanisms to supply running and new tapes, respectively;

a first powered cutter through which the running tape is to pass and be cut, the first cutter being positioned downstream of the first tape feeding mechanism along the first tape;

a powered joining mechanism in which there is an essentially inertia-free accumulation of the new tape, and in which an end portion of the new tape is to be initially joined to the running tape at a position downstream of the cutter;

a moving surface with which a roller is engaged to provide a pinch point on the running tape, the pinch point being positioned downstream of the joining mechanism, wherein the accumulation is at least as long as a tape path between the pinch point and the point at which the new tape and the running tape are to be initially joined; and control circuitry to automatically determine whether tape exhaustion condition has been reached, and to signal the cutter and joining mechanism to join the new and running tapes and cut the running tape before the first tape feeding mechanism runs out of the running tape.

24. The apparatus of claim 23 in combination with said new tape, wherein the end portion of said new tape has attached thereto a piece of double-sided adhesive tape.

25. The apparatus of claim 23 further comprising:

first and second accumulator sections positioned downstream of the first and second tape feeding mechanisms, respectively, and upstream of the joining mechanism, to provide accumulation for the running and new tapes and feedback to control the rate at which tape is fed by the first and second feeding mechanisms so that a constant running tape speed may be maintained downstream of the accumulator sections.

26. An apparatus comprising:

first and second tape feeding mechanisms to supply running and new tapes, respectively;

a first powered cutter by which the running tape is to be cut downstream of the first tape feeding mechanism;

a powered joining mechanism by which an end portion of the new tape is to be held stationary until the moment the end portion of the new tape is joined with the running tape at a position downstream of the first powered cutter, wherein the joining mechanism is to hold an essentially inertia-free accumulation of the new tape so that the new tape, upon being joined with the running tape, accelerates almost instantaneously to the speed of the running tape; and control circuitry to automatically signal the first powered cutter and the powered joining mechanism to join the new and running tapes and cut the running tape before the first tape feeding mechanism runs out of the running tape.

27. The apparatus of claim 26 further comprising:

a movable surface with which a roller is engaged to provide a pinch point on the running tape, the pinch point being positioned downstream of a point at which the end portion of the new tape is joined with the running tape by the powered joining mechanism.

28. The apparatus of claim 27 wherein the essentially inertia-free accumulation is at least as long as a tape path between the pinch point and the point at which the end portion of the new tape is joined with the running tape.

* * * * *